US005839130A

United States Patent [19]

Markus

[11] Patent Number: 5,839,130

[45] Date of Patent: Nov. 24, 1998

[54] COLLAPSIBLE BED-PAN SUPPORT WITH SHEET

[76] Inventor: Robert Markus, 247, Ave. Del Poniente D-2, San Clement, Calif. 92672

[21] Appl. No.: 810,348

[22] Filed: Mar. 3, 1997

[51] Int. Cl.[6] ..... A61G 9/00

[52] U.S. Cl. ..... 4/457; 4/456; 4/450

[58] Field of Search ..... 4/457, 450, 452, 4/453, 454, 455, 456

[56] References Cited

U.S. PATENT DOCUMENTS

| | | | |
|---|---|---|---|
| 1,132,056 | 3/1915 | Wesley et al. . | |
| 1,676,962 | 7/1928 | Murphy . | |
| 3,008,153 | 11/1961 | Coulter . | |
| 3,609,771 | 10/1971 | Avoy . | |
| 3,628,197 | 12/1971 | Leventhal . | |
| 3,728,744 | 4/1973 | Kimbro et al. | 4/11.3 |
| 4,207,633 | 6/1980 | Smith et al. | 5/90 |
| 4,271,546 | 6/1981 | Martin | 4/457 |
| 4,592,589 | 6/1986 | Hellwig . | |
| 4,998,301 | 3/1991 | Markus | 4/457 |
| 5,193,232 | 3/1993 | Fllod et al. | 4/457 |

*Primary Examiner*—David J. Walczak
*Attorney, Agent, or Firm*—Milton S. Gerstein

[57] ABSTRACT

An inflatable bed-pan pad-support of the invention has a shape geometry and configuration in its deflated state that is different from that in its inflated state, so that, when the pad is inflated, it assumes a natural, rectilinear-shaped outline, with the bed-pan receiving, U-shaped opening thereof having a substantially uniform width along its length when the pad is in inflated. Strengthening ribs are provided in the interior of the pad, which additional strengthening ribs extend between the closed, head end of the bed-pan receiving, U-shaped opening and the opposite, head-end end-wall of the pad, which strengthening ribs provide the necessary support to the bed-pan receiving, U-shaped opening so that it assumes, in its inflated state, a uniform width substantially along its length. Another pair of outer strengthening ribs are also provided, one on either lateral side of the U-shaped opening strengthening ribs. The pad is also provided with a specially designed bed-sheet that fits thereunder, which bed-sheet is made up of two interconnected parts, which allow easy and fast disconnection of one part from the other, for ease of handling, changing, and for enhancing comfort to the patient.

11 Claims, 5 Drawing Sheets

COLLAPSIBLE BED-PAN SUPPORT WITH SHEET

BACKGROUND OF THE INVENTION

The present invention is directed to an inflatable bed-pan support, such as that disclosed in commonly-owned U.S. Pat. No. 5,193,232, which disclosure is incorporated herein, which discloses an inflatable bed-pan pad support having an opening for receiving a bed-pan when the pad is inflated, which bed-pan is used by an invalid or infirm patient in order to relieve himself. In the bed-pan pad of U.S. Pat. No. 5,193,232, it has been found that the shape, geometry and orientation of the bed-pan opening of the inflatable pad experiences marked differences between the inflated and deflated states of the pad. In the pad of U.S. Pat. No. 5,193,232, the entrance of the opening for receiving the bed-pan is of the same width as the rear, closed end of the opening, when the pad is deflated. In this deflated state, the opening for the bed-pan would readily and slidingly receive a bed-pan therein, if such were its intended use. However, the pad is intended to receive a bed-pan in its inflated state; however, it has been found that after the pad has been inflated, the width of the opening assumes a more constricted shape in a direction from the rear, closed end toward the entrance-end of the opening, whereby it is not only difficult to initially insert the bed-pan into the opening, but it is even more difficult to retain the bed-pan in place within the opening, since the narrowing width of the opening forces the bed-pan to slide out of the opening. Since the opening of the pad is defined by inflated side walls, which are inherently resilient and elastic, any force tending to push the bed-pan into the opening is counteracted by the side walls forming the opening of the pad, so that, any narrowing of the opening in the direction from the rear, closed end toward the entrance-end would tend to cause the bed-pan to be forced out of the opening. This problem has occurred, since it has been found that the shape, geometry and configuration of the bed-pan pad is different in its inflated state as compared with its deflated state.

The pad of U.S. Pat. No. 5,193,232 was intended for use with a specific type of bed-pan, which has an upwardly-sloping, feet-end section which was intended to serve as a splash guard during patient-urination. However, it has been found that spillage still occurs.

It is, therefore the primary objective to provide a collapsible bed-pan support pad that in its inflated state assumes the proper and desired shape, geometry and configuration, so that when a bed-pan is inserted into the bed-pan receiving opening thereof, the bed-pan does not tend to dislodge and be pushed out of the opening in which it has been inserted. It is also an objective of the present invention to provide a bed-sheet under the patient that protects the bed from spillage during urination, which bed-sheet is easy to use, comfortable to the patient, and easy to replace.

SUMMARY OF THE INVENTION

The inflatable bed-pan pad-support of the invention has a shape geometry and configuration in its deflated state that is different from that in its inflated state, so that, when the pad is inflated, it assumes a natural, rectilinear-shaped outline, with the bed-pan receiving, U-shaped opening thereof having a substantially uniform width along its length when the pad is inflated. Therefore, in the pad's deflated state, the U-shaped bedpan receiving opening is defined by an ever-increasing width therealong in a direction from the rear, closed, or head, end of the opening, toward the feet-end entrance of the bed-pan receiving, U-shaped opening. Moreover, in order to ensure this, additional strengthening ribs are provided in the interior of the pad, which additional strengthening ribs extend between the closed, head end of the bed-pan receiving, U-shaped opening and the opposite, head-end end-wall of the pad, which strengthening ribs provide the necessary support to the bed-pan receiving, U-shaped opening so that it assumes, in its inflated state, a uniform width substantially along its length. Another pair of outer strengthening ribs are also provided, one on either lateral side of the U-shaped opening strengthening ribs. Each outer strengthening rib runs parallel to a side wall of the pad to which it is closest, which side walls extend at an angle to each other rather than parallel, when the pad is deflated, so that, when the pad is inflated, these side walls assume a parallel orientation with each other, so that the entire pad assumes a rectilinear shape when inflated, with right-angle interior corners, which configuration aids the U-shaped opening in maintaining a constant width along its length.

The pad is also provided with a specially designed bed-sheet that fits thereunder, which bed-sheet is made up of two interconnected parts, which allow easy and fast disconnection of one part from the other, for ease of handling, changing, and for enhancing comfort to the patient.

BRIEF DESCRIPTION OF THE DRAWINGS

The invention will be more readily understood with reference to the accompanying drawing, wherein.

DETAILED DESCRIPTION OF THE INVENTION

Figure 1:
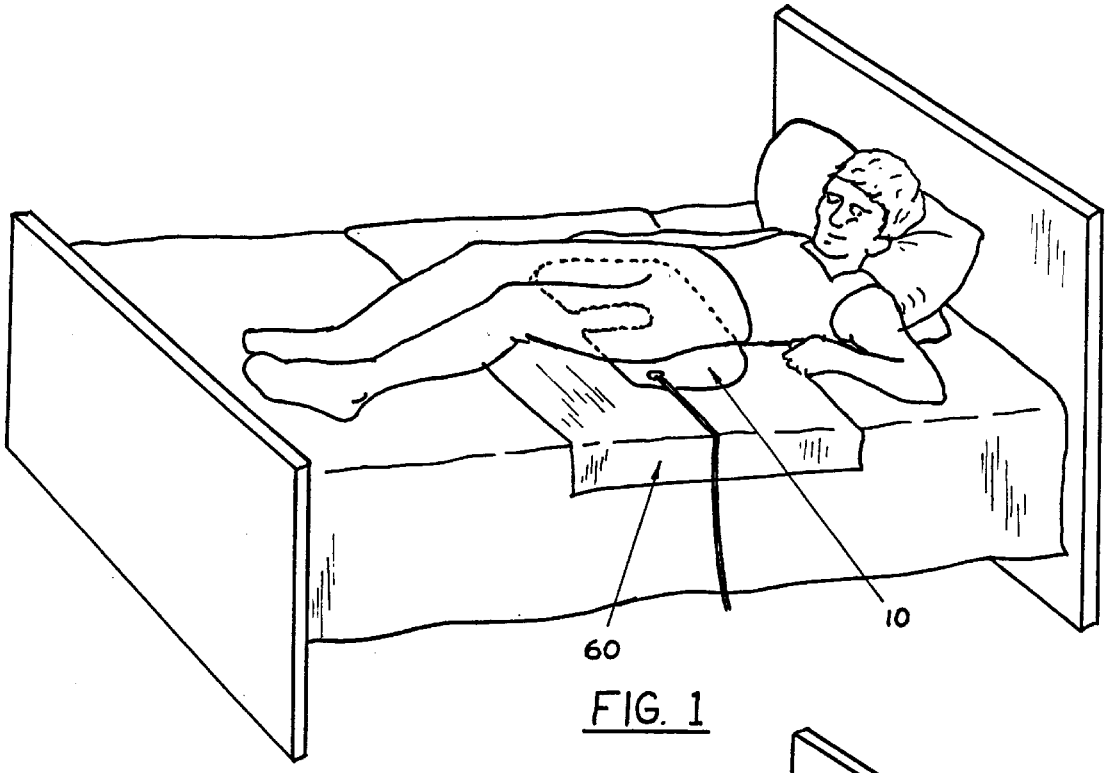
FIG. 1 is an isometric view of the inflatable bed-pan pad of the invention, in its deflated state, with the protective bed-sheet of the invention thereunder.
Figure 2:
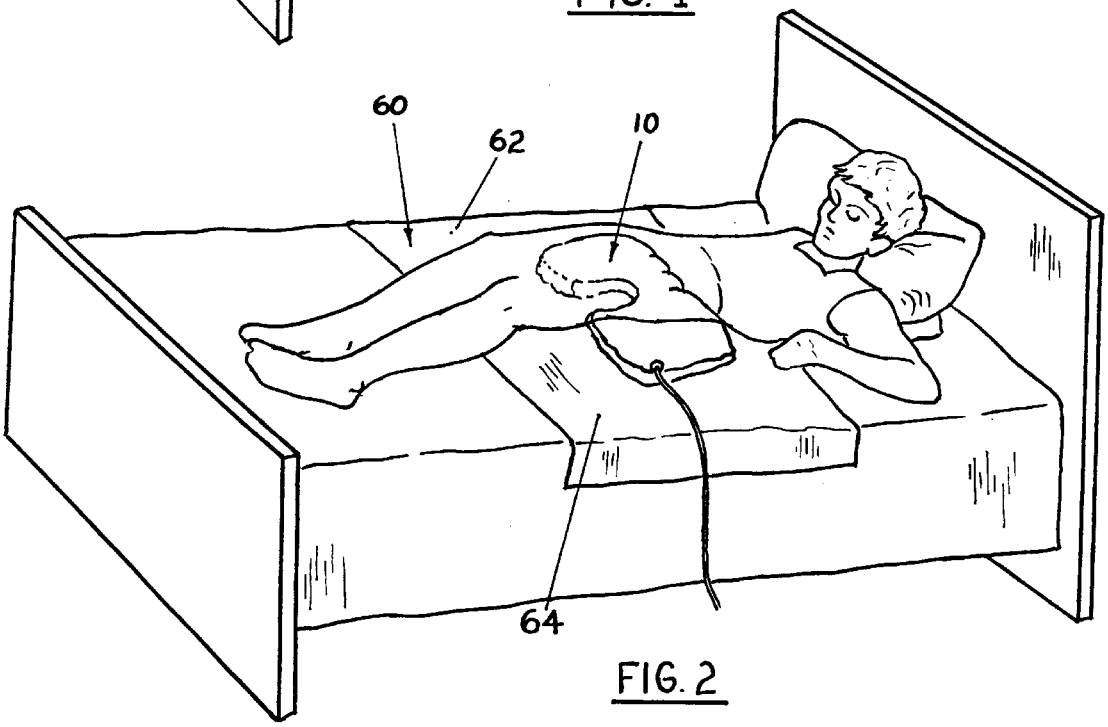
FIG. 2 is an isometric view of the inflatable bed-pan pad of the FIG. 1 shown in its inflated state for receiving a bed-pan.
Figure 3:
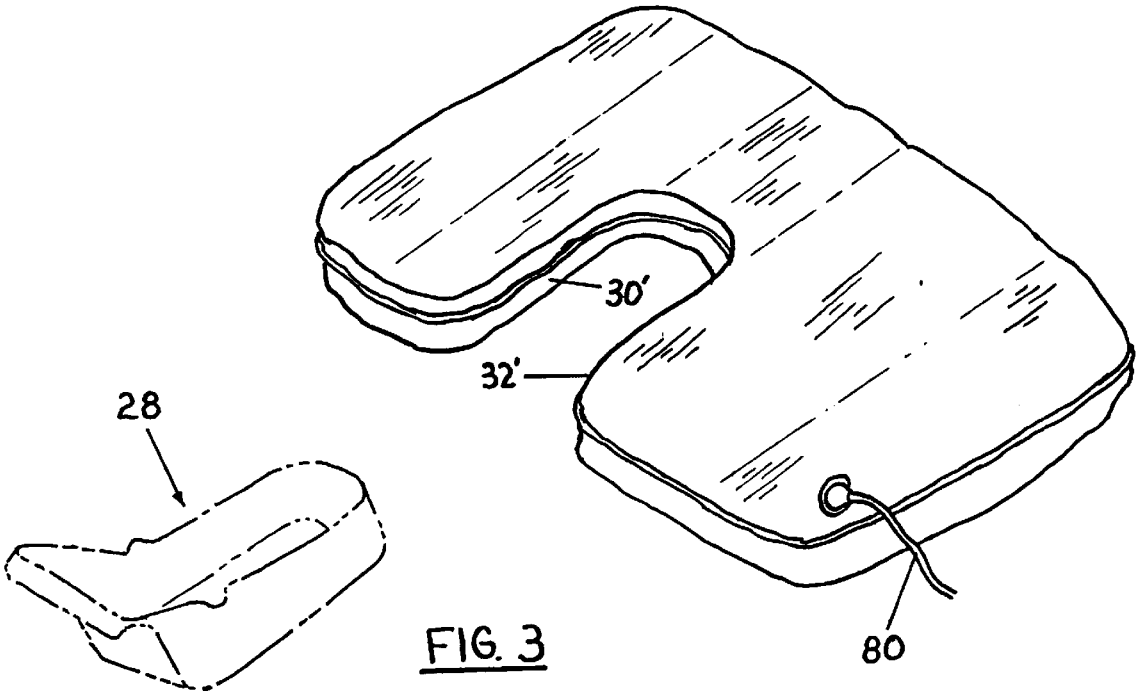
FIG. 3 is an isolated, isometric view of the inflatable bed-pan pad of the invention, in its inflated state, about to receive a bed-pan.
Figure 4:
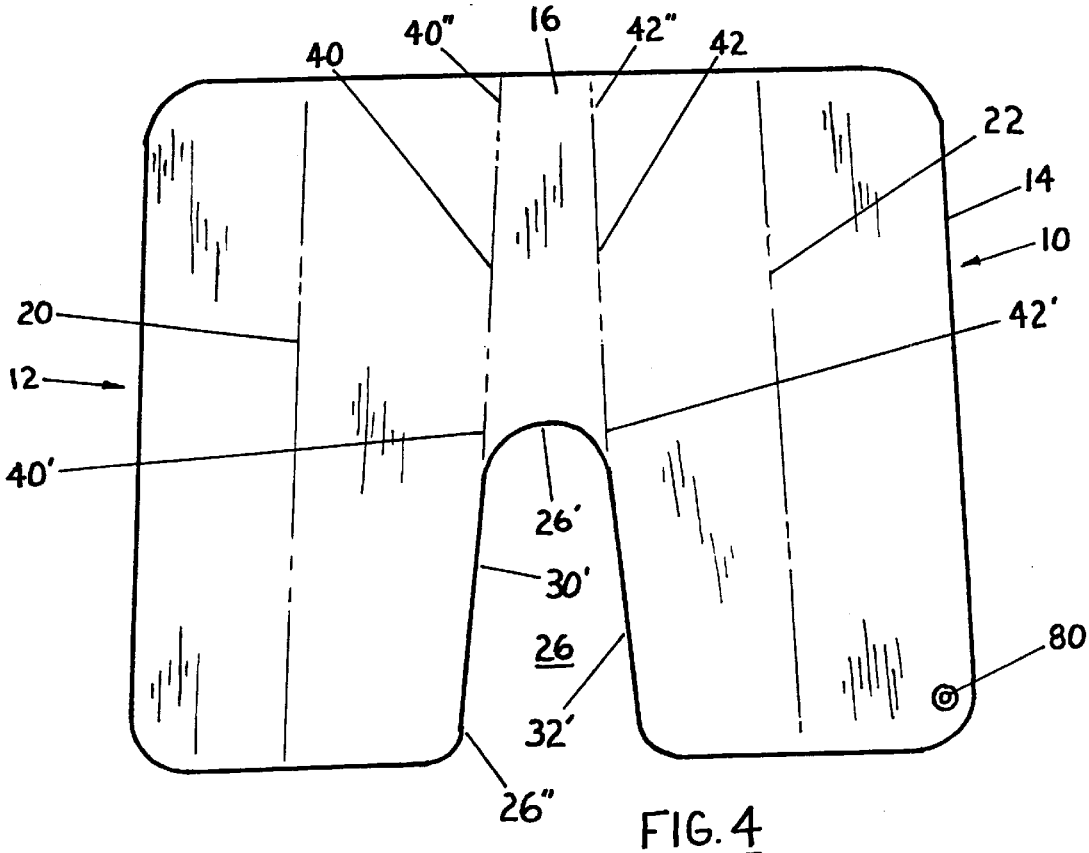
FIG. 4 is a top view thereof in its deflated state.
Figure 5:
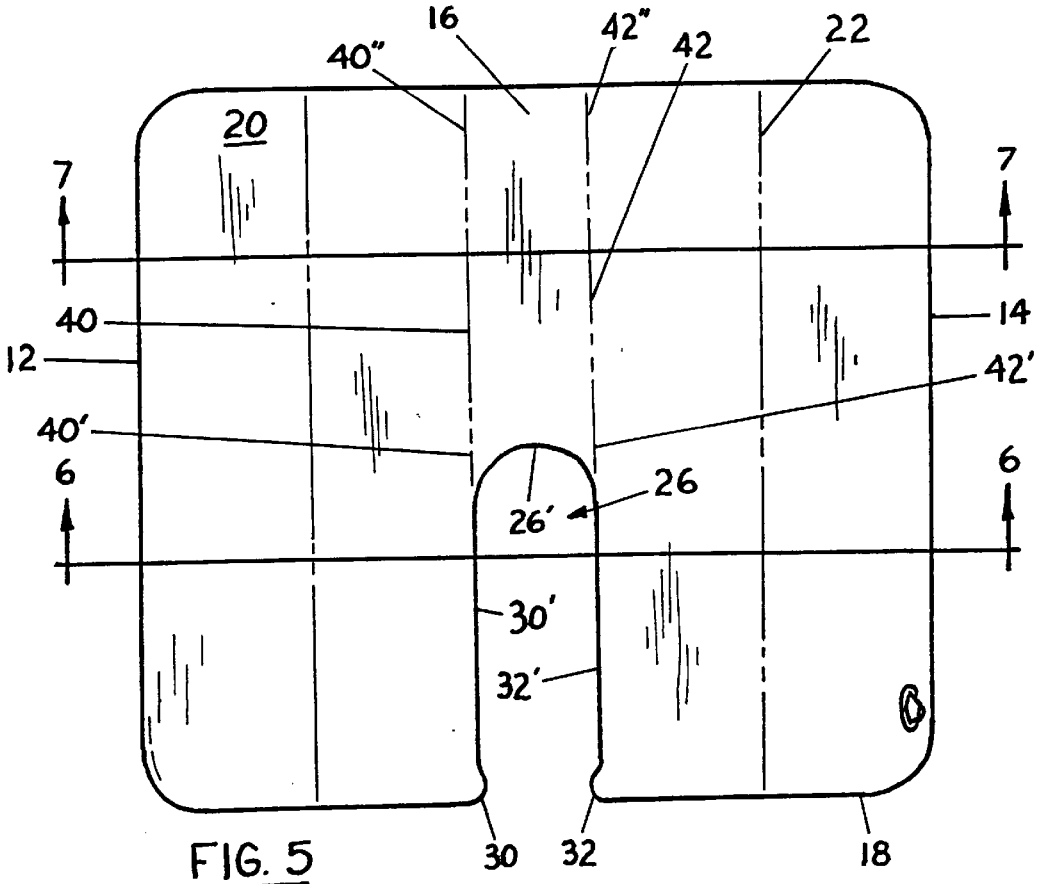
FIG. 5 is a top view thereof in its inflated state.
Figure 6:
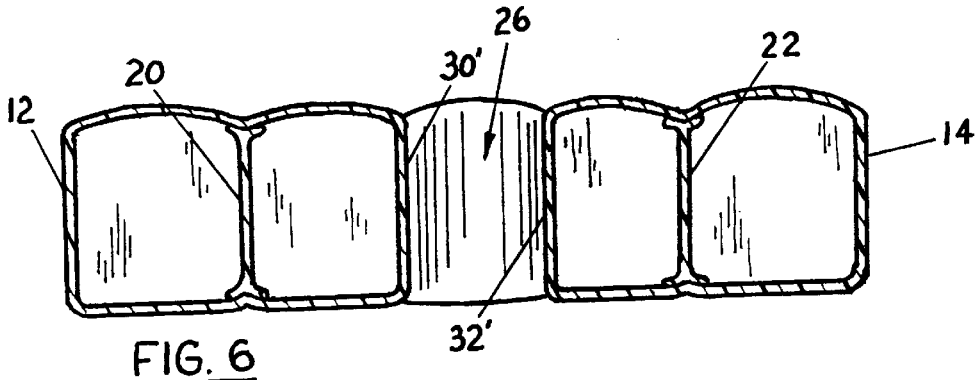
FIG. 6 is a cross-sectional view taken along line 6—6 of FIG. 5.
Figure 7:
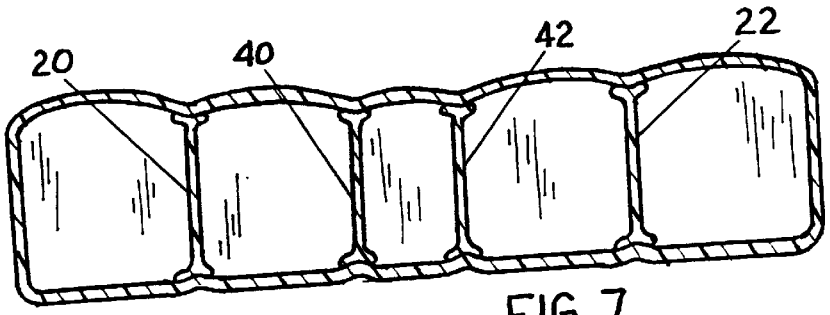
FIG. 7 is a cross-sectional view taken along line 7—7 of FIG. 5.

Referring now to the drawings in greater detail, and to FIGS. 1–7 for now, there is shown the inflatable bed-pan support pan 10 of the invention. The inflatable bed-pan support pan 10, as best seen by comparing FIGS. 4 and 5, assumes a different shape in its deflated state as compared with its inflated state. In its deflated state, the inflatable bed-pan support pan 10 assumes a trapezoidal shape; that is, side walls 12 and 14 are not parallel to each other, while rear wall 16 and front wall 18 are parallel to each other, and with the length of the rear wall 16 being shorter than the length of the front wall 18. Mounted within the interior of the pad 10 are a pair of longitudinally-extending supporting ribs 20, 22, which are also seen in FIGS. 5–7. These ribs 20, 22 are like similarly-located ribs in the pad of commonly-owned U.S. Pat. No. 5,193,232, with the exception that, in the deflated state of the pad, the ribs 20, 22 are not parallel to each other. However, the rib 20 is parallel to the side wall 12, and the rib 22 is parallel to the side wall 14 of the pad 10 of the invention, both in the deflated and inflated states of the pad 10. This configuration of the pad 10 of the invention ensures that when the pad 10 is inflated, it assumes a rectilinear-shape, such as a square-shape with right-angle corners, as seen in FIG. 5, unlike the pad of U.S. Pat. No. 5,193,232, which assumes a rectilinear shape in its deflated shaped, but not one in its inflated state.

The pad 10 of the invention is provided with a U-shaped, bedpan-receiving opening 26 for receiving a bed-pan 28, shown in dotted lines in FIG. 3, when the pad is inflated under a patient. In the deflated state of the pad 10, the U-shaped opening 26 defines an ever-increasing width along its length, from the closed head-end 26' to its open, entrance feet-end 26", as can be seen in FIG. 4, which width of the U-shaped opening is measured in a direction perpendicular to length of a pair of annular side walls thereof. The U-shaped opening 26 defines such an outwardly-flaring design so that when the pad 10 has been inflated, the U-shaped opening 26 will assume a constant width along the entire length thereof, except for the two camming members, or pincher-elements, 30, 32, as seen in FIG. 5, which are the same as those provided in U.S. Pat. No. 5,193,232. These camming members retain the bedpan 28 in the opening via a biasing force, and are received in cutouts formed in the sides of the upwardly-sloping handle-section of the bed pan 28, as shown and described in U.S. Pat. No. 5,193,232. This configuration of the U-shaped opening 26 in the deflated state of the pad 10 is necessary to ensure the constant-width opening 26 of the inflated pad, so that the bed pan 28 inserted therein is allowed to be inserted in a more facile manner, and so that the biasing force from the side walls 30', 32' of the opening 26 do not force the bed pan out of the opening, which is the case in the pad of U.S. Pat. No. 5,193,232.

In order to further ensure that the U-shaped opening 26 assumes a constant-width when the pad 10 is inflated, there are provided two additional strengthening ribs 40, 42, as best seen in FIGS. 4, 5 and 7. Each respective rib 40, 42 has a first end 40', 42' secured close to the rear of the closed head-end 26' of the opening 26. The rib 40 is parallel to, and located interiorly in the support pad of, side wall 30', while the rib 42 is parallel to, and located interiorly in the support pad of, side wall 32'. The two ribs 40, 42 remain parallel to each other both in the deflated and in the inflated states of the pad, and help to retain the opening 26 in its constant-width state when the pad is inflated, by supporting and rigidifying the closed, rear head-end 26' of the opening 26. The pad 10 is inflatable by means of the valve-mechanism 80.

In a preferred form of the pad 10, the dimensions thereof in a deflated state are as follows: rear wall 16 is twenty-six inches, front wall 18 is twenty-eight inches, with the closed, rear, head-end 26' of the opening 26 being four inches, with the opening continuously expanding toward the entrance-end 26", which is 4 ½ inches wide. In the inflated state, the pad 10 is a square of twenty-five inches, with the width of the opening 26 being a constant four inches along the entire length thereof. This constant-width opening 26, when the pad 10 has been inflated, is also achieved by placing each strengthening rib 40, 42 eleven inches from a respective side wall 12, 14 of the pad 10, with the two ribs 40, 42 being spaced three inches apart. Each of the strengthening ribs 20, 22 is spaced from a respective side wall 12, 14 a distance of seven inches. With this pad, a pressurization of the pad to 1 p.s.i. will raise the patient five inches from the top of the bed. Thus, the bed-pan may be inserted into the opening 26 without ever touching the patient. Since the pad 10 of the invention has additional supporting ribs, and since the opening 26 is allowed to expand to a constant width when inflated, the pad of the invention only requires one layer throughout the pad, and not a laminate, such as one layer of vinyl, in contradistinction to the pad of U.S. Pat. No. 5,193,232, which required at least one additional supporting layer of vinyl about the bed-pan-receiving opening for additional strength.

Figure 8:
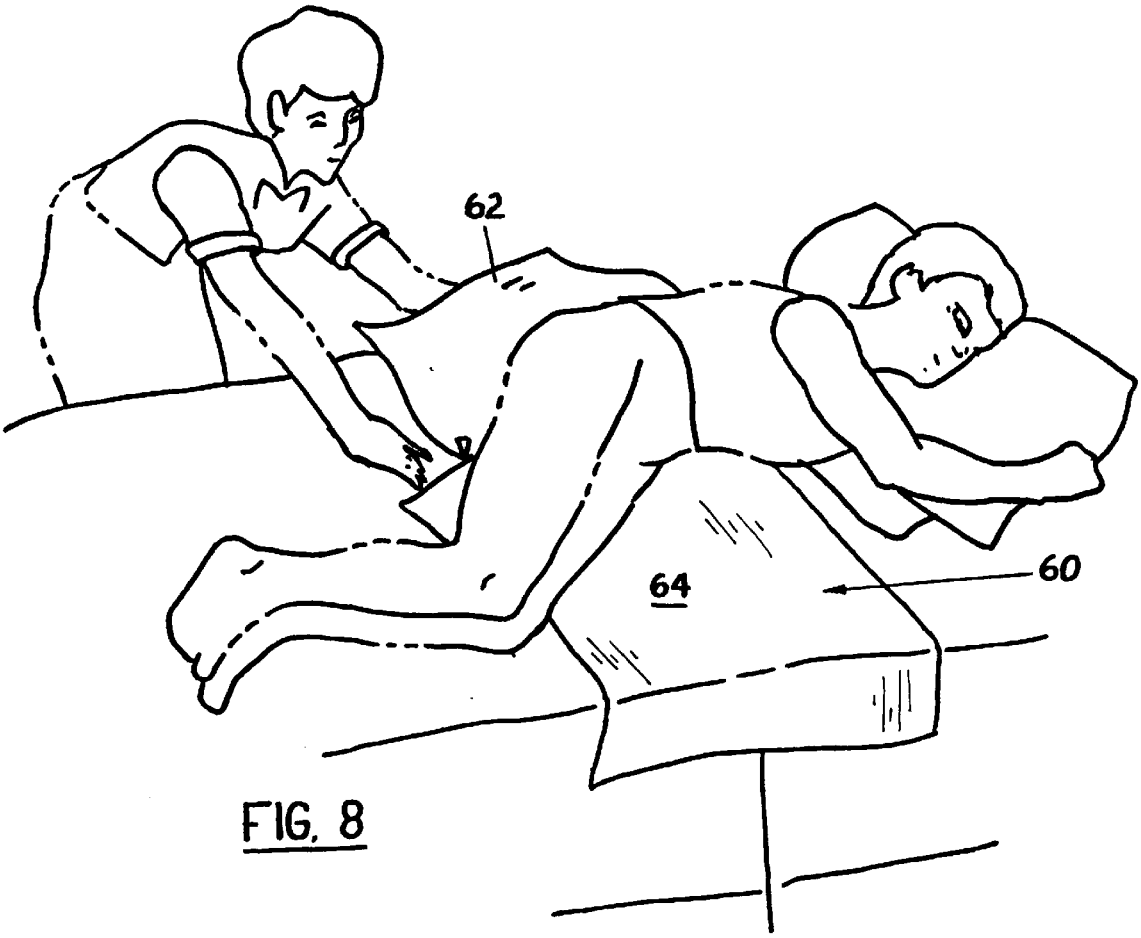
FIG. 8 is an isometric view showing how the two-part bed-sheet of the invention is changed without causing discomfort to the patient.
Figure 9:
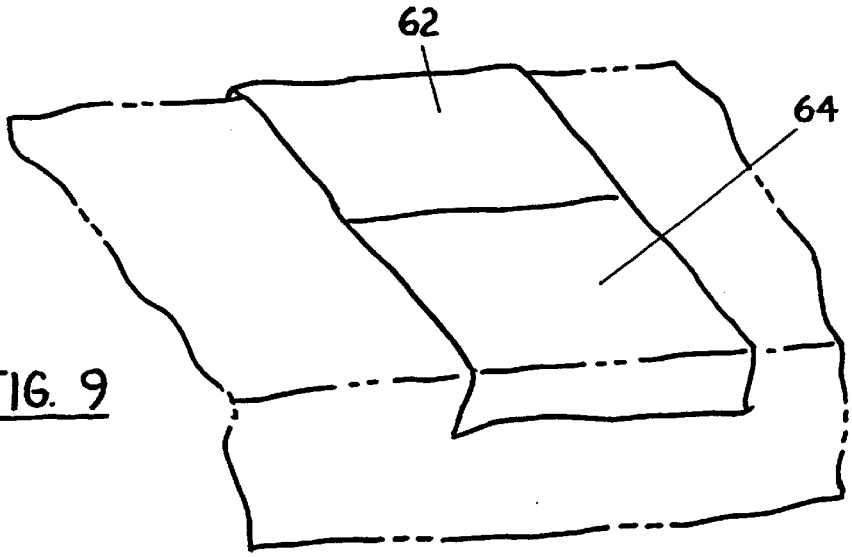
FIG. 9 is an isometric view showing the two part bed-sheet. of the invention on the bed.
Figure 10:
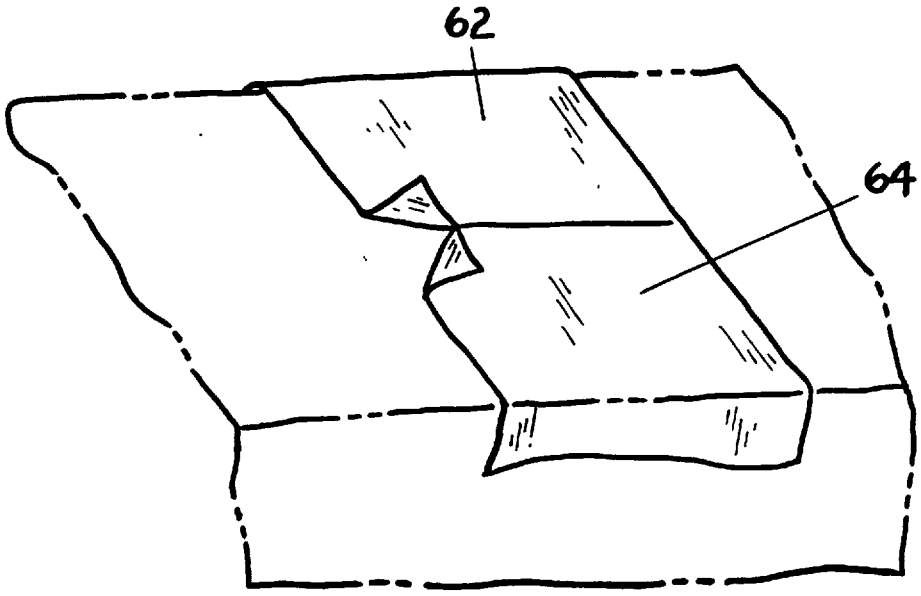
FIG. 10 is an isometric view showing how the two parts of the bed-sheet of the invention are separated.
Figure 11:
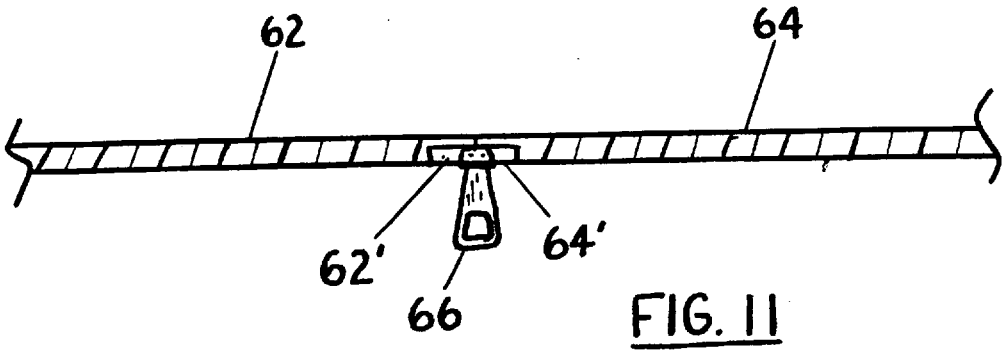
FIG. 11 is a front view of the two-part bedsheet of the invention showing the zipper-connection between the two parts thereof.

The second aspect of the invention is directed to a two-piece bed sheet 60, best seen in FIGS. 8–11. The bed-sheet 60 has two mating sections or parts 62, 64 that are removable connected together by mating zipper sections 62', 64', as seen in FIG. 11. The zipper-pull 66 along with the mating zipper sections 62', 64', are located on the underside of the sections, so that, when the bed-sheet 60 is placed on a bed, the zipper sections and zipper-pull do not contact the body of the patient, in order to ensure comfort to the patient, as can be seen by viewing FIGS. 1 and 2. Each half-section 62,64 of the bed-sheet 60 may have a width allowing a portion thereof to be tucked under the mattress of the bed or, alternatively, the sheet need not be tucked under the mattress, as seen in FIGS. 8–10. The bed-sheet 60 protects the mattress from any spillage that may occur while the patient is urinating into the bed-pan 28. Since the bed-sheet is made of two, removably secured half-sections, such allows the changing of the bed sheets in a manner that is least bothersome and painful to the patient. To remove the spoiled bed sheet 60, the caregiver simply positions the patient on one side, as seen in FIG. 8, and unzips the two sections, and removes that unzipped section 62 which the patient is not lying on. The caregiver then places a new , clean half-section 62 in place of the spoiled one, and then positions the patient on his other side, whereupon the other, spoiled half-section 64 is removed, and a new, clean half-section 64 emplaced and zipped onto the other clean half-section 62. The patient is then returned to his normal, supine position. Thus, it may be seen, that the bed-sheet may be changed without requiring the patient to be removed from the bed, or even to have the patient moved to a sitting position. It is, of course, possible to use hook-and-pile strips instead of the zipper sections to removably secure the two half-sections of the sheet. In one preferred embodiment, each half-section of bedsheet is thirty inches by sixty inches.

While specific embodiments of the invention have been shown and described, it is to be understood that numerous changes and modifications may be made therein without departing from the scope, spirit and intent of the invention as set forth in the appended claims.

The pad of the invention is only 1/16 inches thick when deflated, in contrast to the multi-layered pad of U.S. Pat. No. 5,193,232, which was two inches thick when deflated. The height of the pad of the invention is about six inches when inflated.

While specific embodiments of the invention have been shown and described, it is to be understood that numerous changes and modifications may be made therein without departing from the scope, spirit and intent of the invention as set forth in the appended claims.

What I claim is:

1. In an inflatable support-pad for a bed pan, which support pad comprises a front wall, a rear wall, a first side wall, and a second side wall, said support-pad having a opening formed therein for receiving a bed pan when the support-pad is inflated, said opening having a first entrance-end adjacent said front wall and a second closed end interiorly thereof, said support pad having a plurality of interior supporting ribs, the improvement comprising:

said opening being a substantially U-shaped opening having a width, as measured in a direction perpendicular to a length of said side walls, that progressively increases from said second closed end of said opening toward said first entrance-end thereof, when said support-pad is deflated; said opening having a pair of annular side walls the perpendicular distance between which at any section thereof defining the width of that section of said U-shaped opening;

said support-pad, when in its deflated state, forming a substantially trapezoidal shape with said front wall having a greater length than said rear wall;

said plurality of interior supporting ribs comprising a pair of spaced-apart longitudinally extending ribs, each having a first end at least extending interiorly to close juxtaposition with said second closed end of said opening, and a second end extending interiorly to at least close juxtaposition to a portion of said rear wall, whereby said U-shaped opening, when said support-pad has been fully inflated, assumes a substantially constant width along at least most of the length thereof from said second closed end to at least close juxtaposition to said first entrance-end.

2. The inflatable support-pad for a bed pan according to claim 1, wherein, when said support-pad has been fully inflated, said annular side walls of said U-shaped opening are parallel to each other, and when said support-pad has been deflated, said annular side walls of said U-shaped opening diverge in a direction from said closed end thereof toward said entrance-end thereof; one said spaced-apart longitudinally extending rib extending substantially parallel to, and interiorly of, one said annular side wall of said U-shaped opening, and the other said spaced-apart longitudinally extending rib extending substantially parallel to, and interiorly of, the other said annular side wall of said U-shaped opening.

3. The inflatable support-pad for a bed pan according to claim 2, wherein said plurality of ribs further comprise another pair of spaced-apart longitudinally extending ribs, each said rib of said another pair having a first end-at least extending interiorly to close juxtaposition with said front wall, and a second end extending interiorly to at least close juxtaposition to a portion of said rear wall, whereby said U-shaped opening, when said support-pad has been fully inflated, assumes a substantially constant width along at least most of the length thereof from said second closed end to at least close juxtaposition to said first entrance-end; said another pair of spaced-apart longitudinally extending ribs sandwiching therebetween said pair of spaced-apart longitudinally extending ribs.

4. The inflatable support-pad for a bed pan according to claim 1, wherein said plurality of ribs further comprise another pair of spaced-apart longitudinally extending ribs, each said rib of said another pair having a first end at least extending interiorly to close juxtaposition with said front wall, and a second end extending interiorly to at least close juxtaposition to a portion of said rear wall, whereby said U-shaped opening, when said support-pad has been fully inflated, assumes a substantially constant width along at least most of the length thereof from said second closed end to at least close juxtaposition to said first entrance-end; said another pair of spaced-apart longitudinally extending ribs sandwiching therebetween said pair of spaced-apart longitudinally extending ribs.

5. The inflatable support-pad for a bed pan according to claim 4, wherein each said another rib of said another pair of spaced-apart longitudinally extending ribs is located between a respective said side wall of said support-pad and a respective said annular side wall of said U-shaped opening, and extends at least most of the length of the interior of said support pad from said front wall to said rear wall.

6. The inflatable support-pad for a bed pan according to claim 5, wherein each said another rib of said another pair of spaced-apart longitudinally extending ribs is parallel to the respective said side wall to which it is closest, both in the deflated and inflated states of said support-pad.

7. The inflatable support-pad for a bed pan according to claim 1, further comprising a bed sheet for placement under said support-pad on a bed, said bed sheet comprising a pair of removably securable sections; each said section comprising cooperating means for removably securing said sections together.

8. The inflatable support-pad for a bed pan according to claim 7, wherein each section of said bed sheet comprises in interior edge-surface facing toward the interior edge-surface of the other said section; said cooperating means of each said section being located at said interior edge-surface.

9. The inflatable support-pad for a bed pan according to claim 8, wherein each cooperating means comprises zipper means, and a zipper-pull; each said section comprising an upper, patient-facing surface, and a bottom, bed-facing surface; said zipper means and zipper-pull being located at said interior edge-surfaces on the bottom, bed-facing surfaces thereof, whereby the patient does not come into contact with them.

10. The inflatable support-pad for a bed pan according to claim 8 wherein each said section comprises an upper, patient-facing surface, and a bottom, bed-facing surface; said cooperating means of each said section being located at said interior edge-surface on the bottom, bed-facing surface thereof, whereby the patient does not come into contact with them.

11. A method changing a bed sheet, which bed sheet comprises a pair of removably securable sections; each said section comprising cooperating means for removably securing said sections together, each section of said bed sheet comprises an interior edge-surface facing toward the interior edge-surface of the other said section; said cooperating means of each said section being located at said interior edge-surface; each said section comprising an upper, patient-facing surface, and a bottom, bed-facing surface; said cooperating means of each said section.

* * * * *